US005151005A

United States Patent [19]

Spigner

[11] Patent Number: 5,151,005

[45] Date of Patent: Sep. 29, 1992

[54] CAN COLLECTION APPARATUS

[76] Inventor: Kenneth W. Spigner, P.O. Box 77, Tatums, Okla. 73087

[21] Appl. No.: 579,161

[22] Filed: Sep. 7, 1990

[51] Int. Cl.[5] ..... B60P 1/00

[52] U.S. Cl. ..... 414/437; 56/328.1; 414/501; 414/507; 280/462

[58] Field of Search ..... 414/501, 502, 503, 504, 414/505, 523, 434, 437, 439, 441, 442, 518, 551, 555, 507, 508; 198/518; 280/478.1, 479.5, 462; 56/12.5, 14.1, 14.2, 14.9, 15.5, 328.1, 372, DIG. 14

[56] References Cited

U.S. PATENT DOCUMENTS

| | | | |
|---|---|---|---|
| 2,365,540 | 12/1944 | Fonken . | |
| 2,651,902 | 9/1953 | Curry | 55/17 |
| 2,658,637 | 11/1953 | Bailey . | |
| 2,780,904 | 2/1957 | Bowie et al. | 56/328.1 |
| 2,812,871 | 11/1957 | Woodall . | |
| 3,175,714 | 3/1965 | Wittek . | |
| 3,746,099 | 7/1973 | Black | 173/63 |
| 3,784,037 | 1/1974 | Woodall . | |
| 3,788,506 | 1/1974 | Lee . | |
| 3,807,154 | 4/1974 | Moore | 56/328 R |
| 3,948,399 | 4/1976 | Michaels | 1298/518 X |
| 3,995,759 | 12/1976 | Hollrock et al. . | |
| 4,014,446 | 3/1977 | Stedman et al. | 414/507 X |
| 4,042,140 | 8/1977 | McFarland | 414/501 X |
| 4,221,524 | 9/1980 | Morris | 414/439 |
| 4,792,271 | 12/1988 | Akel | 414/440 |

FOREIGN PATENT DOCUMENTS

| | | | |
|---|---|---|---|
| 3230748 | 2/1984 | Fed. Rep. of Germany | 414/502 |

*Primary Examiner*—Frank E. Werner

*Attorney, Agent, or Firm*—Laney, Dougherty, Hessin & Beavers

[57] ABSTRACT

An apparatus for collecting cans from a ground surface. The apparatus comprises a basket portion having a carriage pivotally attached thereto. A bearing mounted shaft extends transversely across said carriage, and a plurality of flexible discs are connected to said shaft. At least one carriage wheel is attached to said shaft and has an outside diameter greater than an outside diameter of the discs. The carriage may be locked in a non-operating position wherein the carriage wheel and discs are spaced from the ground surface, and the carriage may be pivoted downwardly to an operating position wherein the carriage wheels engage the ground surface. The discs flex outwardly from one another when a can is pushed therebetween so that the discs engage the can and move it toward the basket portion. A can disengaging finger is positioned between pairs of adjacent discs for disengaging the cans therefrom so that the cans are free to fall into the basket portion. The basket portion may be mounted on a ground engaging wheel and may further be connected to a vehicle by a trailer hitch mounted on a tongue. The tongue may be pivoted to one of a plurality of operating positions. A can orienting device is positioned forwardly of the carriage for orienting the cans generally longitudinally with respect to said the basket portion so that they may be properly engaged by the flexible discs.

27 Claims, 2 Drawing Sheets

CAN COLLECTION APPARATUS

BACKGROUND OF THE INVENTION

1. Field Of The Invention

This invention relates to devices used for collecting discarded cans, and more particularly, to an apparatus which may be pulled along a ground surface with cans thereon and having a plurality of flexible discs positionable adjacent to the ground surface for engaging the cans and moving them into a retrieval basket.

2. Description Of The Prior Art

Litter discarded along the side of the road and in other areas is a well known problem. Much of this litter is in the form of aluminum beverage cans which have a substantially indefinite life, and thus remain a litter problem until picked up. Therefore, there is a need to collect such cans to reduce the litter.

In addition to the aesthetic reasons for collecting aluminum cans, the aluminum material in the cans has value. In recent years, aluminum recycling centers have been opened where scrap aluminum may be sold. Probably the majority of the aluminum brought to these centers for recycling is in the form of used beverage cans. Thus, there are economic reasons for collecting the cans, and there exists a need for selectively retrieving cans in an economical manner for recycling.

U.S. Pat. No. 3,746,099 to Black is for picking up litter wherein a plurality of tines penetrate the litter, and the litter is then stripped off the tines into a basket. The problem with this device is that it picks up all kinds of litter and does not selectively retrieve aluminum beverage cans.

Another apparatus for retrieving litter is disclosed in U.S. Pat. No. 3,807,154 to Moore which picks up litter between a plurality of independently biased fingers. Again, this device is used to pick up litter other than cans.

The apparatus of the present invention solves the problems of Black and Moore, and addresses the need for an apparatus for picking up aluminum cans in that it is more selective and substantially avoids picking up other litter. This is made possible by a plurality of flexible discs which may be positioned adjacent to the ground and which catch the cans between adjacent pairs thereof. A somewhat similar structure is found in the stone collector of Curry U.S. Pat. No. 2,651,902, and in a number of golf ball retrieving devices, for example, U.S. Pat. No. 3,995,759 to Hollrock, et al. Neither the apparatus of Curry nor the golf ball retrieving apparatus are designed for use in collecting beverage cans or are as easily transported as the present invention.

SUMMARY OF THE INVENTION

The can collection apparatus of the present invention is used for collecting cans from a ground surface, such as discarded cans along the side of a road or in other areas. The apparatus is designed to be pulled along the ground surface to collect and store the cans. Generally, the apparatus comprises can receiving means for receiving the cans therein and can collecting means adjacent to the receiving means for collecting cans from the ground surface and moving the collected cans into the can receiving means when the can collecting means is in an operating position adjacent to the ground surface. The can collecting means further has a non-operating position spaced above the ground surface. Locking means may be provided for locking the can collecting means in the non-operating position.

The can receiving means is preferably characterized by a basket portion positioned substantially forwardly of the can collecting means. The can receiving means defines an opening in the lower portion thereof in which the can collecting means is positioned. The can collecting means is preferably hingedly attached to the can receiving means and thereby pivotable between the operating and non-operating positions.

In the preferred embodiment, the can collecting means comprises a carriage pivotally connected to the can receiving means, a shaft extending transversely with respect to the carriage and rotatable with respect thereto, and a plurality of flexible discs attached to the shaft and mutually rotatable therewith. The discs are spaced from one another a distance less than a diameter of at least some of the cans such that any pair of the discs deflect away from one another for grippingly engaging a can on the ground surface, and, after further rotation, the can is moved adjacent to the can receiving means. A means may be provided for disengaging the cans from the discs such that the cans are free to fall into the can receiving means. The means for disengaging is preferably characterized by a plurality of fingers, each finger extending between a pair of adjacent discs. The fingers curve upwardly with respect to the can receiving means and are preferably attached to a front portion of the carriage.

A carriage wheel may be mounted on the shaft for engaging the ground surface when the can collecting means is in the operating position. Preferably, a wheel is used on opposite sides of the plurality of discs. The outside diameter of the discs is preferably smaller than an outside diameter of the carriage wheel or wheels.

The apparatus may further comprise can orienting means for orienting the cans on the ground surface in a position substantially longitudinally with respect to the can receiving means prior to collection by the can collecting means. The can orienting means may be characterized by a plurality of strips hanging downwardly from the can receiving means. A bottom edge of the strips is spaced from the ground surface a distance less than a diameter of at least some of the cans, and the strips are transversely spaced from one another a distance less than a length of at least some of the cans.

Preferably, the apparatus is in the form of a trailer having ground engaging wheels attached to the can receiving means for supporting the can receiving means above the ground surface, and the apparatus may further comprise means for attaching the can receiving means to a trailer connection on a vehicle. The means for attaching to a trailer connection preferably comprises a tongue attached to the can receiving means and a trailer hitch disposed on the tongue for engaging the trailer connection on the vehicle. Preferably, the tongue is pivotally connected to the can receiving means such that the tongue and trailer hitch may be pivoted to one of a plurality of tongue operating positions. Locking means may be provided for locking the tongue in any of the tongue operating positions.

It is an important object of the invention to provide an apparatus for quickly retrieving discarded aluminum beverage cans while minimizing the collection of any other litter.

Another object of the invention is to provide an apparatus for collecting discarded cans which has an operating position adjacent to the ground and a non-operating position spaced from the ground so that the apparatus is easily transported.

An additional object of the invention is to provide an apparatus for collecting aluminum cans with means for generally positioning the aluminum cans longitudinally with respect to the apparatus.

A further object of the invention is to provide an apparatus for collecting aluminum cans wherein the cans are engaged and picked up between pairs of flexible discs so that the cans are moved from the ground to a collection basket.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
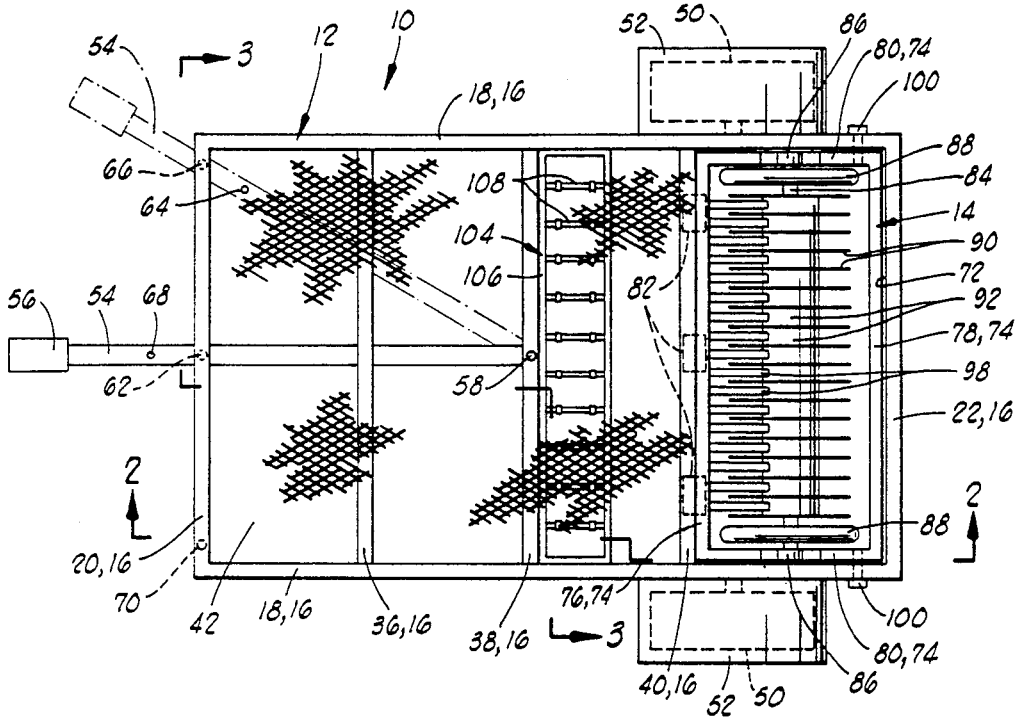
FIG. 1 is a plan view of the can collection apparatus of the present invention.
Figure 2:
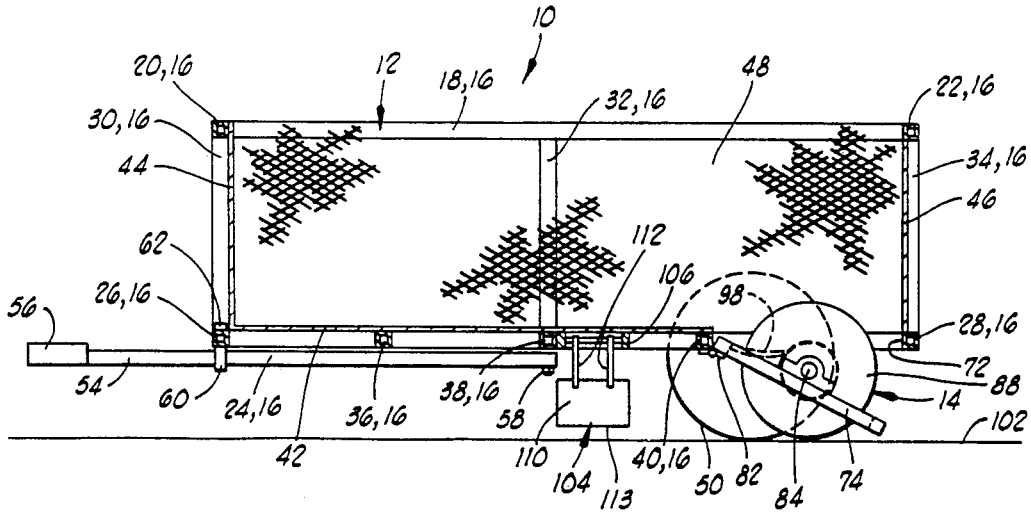
FIG. 2 is a cross-sectional view taken along lines 2—2 in FIG. 1.
Figure 3:
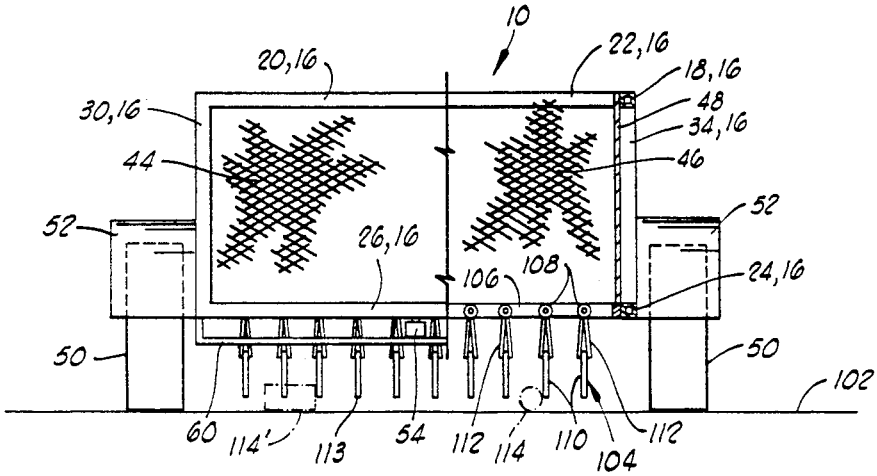
FIG. 3 is a partial front elevation and partial cross section taken along lines 3—3 in FIG. 1.

Referring now to the drawings, and more particularly to FIGS. 1-3, the can collection apparatus of the present invention is shown and generally designated by the numeral 10. Apparatus 10 is generally in the configuration of a trailer with a forward, can receiving means, such as a collection or retrieving basket portion 12, and having a can collecting means 14 positioned toward the rear of the basket portion.

Basket portion 12 comprises a frame 16 of generally parallelepiped configuration. Frame 16 includes upper longitudinal members 18 interconnected by upper front transverse member 20 and upper rear transverse member 22. Frame 16 further includes lower longitudinal members 24 interconnected by lower front transverse member 26 and lower rear transverse member 28.

A pair of front vertical members 30, a pair of intermediate vertical members 32, and a pair of rear vertical members 34 interconnect the corresponding upper and lower longitudinal and transverse members.

Frame 16 may also include intermediate transverse members 36, 38 and 40 extending between lower longitudinal members 24.

Basket portion 12 further comprises a bottom panel 42 extending from lower front transverse member 26 to intermediate transverse member 40 and which is supported at least in part on intermediate transverse members 36, 38 and 40. A front panel 44 extends transversely between front vertical members 30, and similarly, a rear panel 46 extends transversely between rear vertical members 34. A pair of side panels 48 extend longitudinally between corresponding front vertical members 30 and rear vertical members 34. In the preferred embodiment, bottom panel 42, front panel 44, rear panel 46 and side panels 48 are formed of expanded metal, although other panel configurations could also be used. It is not intended that the invention be limited to expanded metal panels.

Frame 16 of basket portion 12 is supported on a pair of ground engaging wheels 50 which are mounted to the frame in any manner known in the art. If desired, fenders 52 may be disposed above and adjacent to wheels 50.

Apparatus 10 is connectable to a vehicle by a tongue 54 having a trailer hitch 56 of a kind known in the art thereon. Tongue 54 is pivotally connected to intermediate member 38 of frame 16 by pivot pin 58.

At the front of frame 16, tongue 54 extends through a guide 60 attached to lower front transverse member 26 as best seen in FIG. 3. In a normal operating position shown in solid lines in FIG. 1, tongue 54 extends substantially longitudinally and is substantially parallel to, and centered between, lower longitudinal members 24. It is held in this position by a pin 62 which extends through lower front transverse member 26 into hole 64 in tongue 54.

Tongue 54 may be pivoted to an alternate operating position in which pin 62 is positioned through hole 66 in lower front transverse member 26 and hole 68 in tongue 54. Tongue 54 is thus angled from the normal operation position. This angled position of tongue 54 is shown in phantom lines in FIG. 1. Further, tongue 54 may be pivoted the other direction to an additional operating position in which pin 62 is positioned through hole 70 in lower front transverse member 26 and hole 68 in tongue 54. The applications for the various operating positions will be further discussed herein.

Referring again to FIGS. 1 and 2, a generally rectangular opening 72 is formed at the rear of frame 16 by intermediate member 40, lower rear transverse member 28 and rearward portions of lower longitudinal members 24. Can collection means 14 is positioned in this opening 72.

Referring now to FIGS. 1, 2, 4 and 5, can collection means 14 preferably comprises a generally rectangular carriage 74. Carriage 74 is formed by front transverse member 76 and a rear transverse member 78 interconnected by a pair of longitudinal members 80. Front transverse member 76 of carriage 74 is attached to intermediate transverse member 40 of frame 16 by a plurality of hinges 82.

Can collection means 14 further comprises a transversely extending axle 84 supported on opposite ends by bearings 86, such as pillow block bearings, mounted on longitudinal members 80 of carriage 74. A carriage wheel 88 is mounted on each end of shaft 84 adjacent to a corresponding bearing 86. Carriage wheels 88 may be of a kind known in the art, such as bicycle wheels. As will be further discussed herein, carriage wheels 88 are adapted for engagement with the ground and are attached to shaft 84 for mutual rotation therewith.

Figure 4:
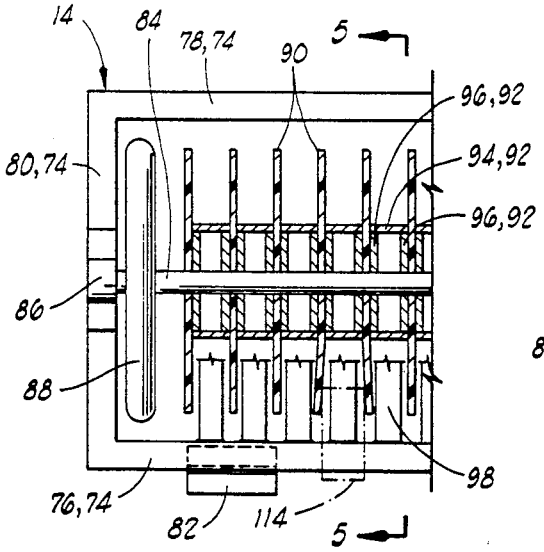
FIG. 4 shows an enlarged cross-sectional view of a portion of a can engaging means of the apparatus.
Figure 5:
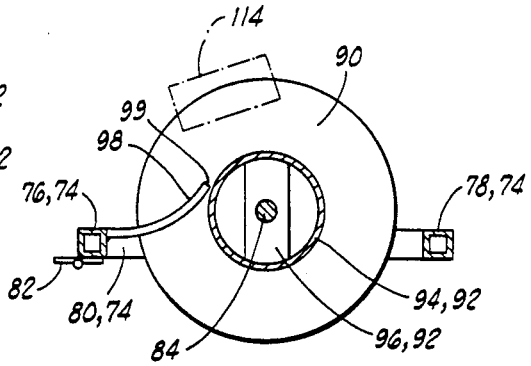
FIG. 5 is a cross section taken along lines 5—5 in FIG. 4.

As seen in FIGS. 1, 4 and 5, can engaging means, such as a plurality of substantially flexible discs 90, are mounted on shaft 84 between carriage wheels 88. As further mentioned herein, the diameter of discs 90 is preferably slightly less than the diameter of carriage wheels 88. Discs 90 are omitted for clarity from FIG. 3.

Between each adjacent pair of discs 90 is a hub 92. Hubs 92 are sized such that the spacing between adjacent pairs of discs 90 is slightly less than the diameter of a typical aluminum beverage can.

As seen in FIGS. 4 and 5, each hub 92 is formed by an outer ring 94 with a pair of spokes 96. While ring 94 and spokes 96 are shown as separate components in FIG. 4, they may be integrally formed. Discs 90 and hubs 92 are adapted for mutual rotation with axle 84 as carriage wheels 88 traverse ground surface 102, as further described herein.

Referring again to FIGS. 1, 2, 4 and 5, a plurality of generally curvilinear fingers 98 are attached to front transverse member 76 of carriage 74 and curve rearwardly and upwardly therefrom. Each finger 98 extends between a corresponding pair of discs 90 such that the rearwardmost tip 99 thereof is adjacent to ring 94 of the corresponding hub 92, as best seen in FIG. 5.

In FIG. 1, can collection means 14 is shown in a raised, non-operating position. In this operating position, longitudinal members 80 of carriage 74 are adjacent and parallel to corresponding lower longitudinal members 24 of frame 16. In other words, carriage 74 is substantially coplanar with the lower portion of frame 16 defined by transverse members 20, 36, 38, 40 and 22 and longitudinal members 18. Pins 100 extend through the lower longitudinal members 24 on each side of frame 16 and the corresponding longitudinal members 80 of carriage 74. In this position, wheels 88, and thus discs 90, are spaced above ground surface 102 upon which apparatus 10 is moved.

Pins 100 are removable such that carriage 74 is pivoted about hinges 82 downwardly toward ground surface 102 as seen in FIG. 2. In this position, carriage wheels 88 engage ground surface 102 just as wheels 50 already do.

Can collection apparatus 10 may further comprise a can orienting means 104. In the embodiment shown, can orienting means 104 comprises a relatively small rectilinear frame 106 positioned longitudinally immediately behind intermediate transverse member 38 of frame 16. A plurality of longitudinally extending rods 108 are mounted in frame 106.

As best seen in FIGS. 2 and 3, a can orienting strip 110 is hung from each rod 108 by a hanger 112. Hangers 112 are pivotal on rods 108 so that strips 110 may swing about the rods. Bottom edges 113 of orienting strips 110 are preferably spaced above ground surface 102 a distance less than the diameter of a typical aluminum beverage can 114'. See FIG. 3. The transverse spacing between pairs of orienting strips 110 is preferably somewhat less than the length of a typical can 114'.

OPERATION OF THE INVENTION

When being transported to a location for collecting discarded cans, can collection apparatus 10 will be in the normal configuration shown in FIG. 1. That is, tongue 54 will generally be in its center position, and can collection means 14 will be in the raised, non-operating position in which it is held in place by pins 100.

Once apparatus 10 is at the site, tongue 54 is placed in one of the operating positions previously discussed. Whether tongue 54 is in the normal position shown in solid lines in FIG. 1, or whether it is pivoted to one side or the other as indicated by the phantom lines in FIG. 1, depends upon the location and the type of vehicle being used to pull apparatus 10. Preferably, tongue 54 is positioned so that the wheels of the vehicle pulling apparatus 10 do not travel across the area between wheels 50. In this way, the wheels of the vehicle will not crush cans in the path of apparatus 10 so that the apparatus cannot pick them up.

Can collection means 14 is lowered to the operating position shown in FIG. 2 by removal of pins 100. As previously discussed, carriage wheels 88 then engage ground surface 102, and the outside diameters of discs 90 are sized to be slightly less than the outside diameters of carriage wheels 88. In this way, contact by discs 90 with ground surface 102 is minimized or eliminated. This reduces the possible wear on flexible discs 90.

As can collection apparatus 10 is pulled along ground surface 102 to collect the cans, the cans will first contact orienting strips 110 of can collection means 104. If a can 114' is laying so that its central axis is perpendicular to strips 110, as seen in FIG. 3, at least one strip 110 will contact the can because the distance between the strips is less than the length of the can. Strips 110 will tend to move the cans so that they are oriented with their central axes extending approximately longitudinally with respect to apparatus 10. Such a properly oriented can 114 is also shown in FIG. 3.

As apparatus 10 continues to move in a forward direction, the properly oriented can 114 is forced between the edges of a pair of discs 90, as indicated in FIG. 4. Discs 90 flex outwardly away from one another to grippingly engaging can 114.

Carriage wheels 88 rotate along ground surface 102, thereby rotating shaft 84 and discs 90. Can 114 is carried around by discs 90 as they rotate, as seen in FIG. 5. Eventually, can 114 will come in contact with the corresponding finger 98 which will dislodge the can from the pair of discs 90. Can 114 will then fall into basket portion 12 of apparatus 10. Cans will accumulate in basket portion 12.

Apparatus 10 is easily transported to the clean-up site, and it is easily and quickly used to pick up cans 114. In addition, apparatus 10 may even be used to transport the collected cans to a recycling location because the storage capacity of basket portion 12 is relatively large.

It will be seen, therefore, that the can collection apparatus of the present invention is well adapted to carry out the ends and advantages mentioned as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. An apparatus for collecting cans from a ground surface, said apparatus comprising:

can receiving means for receiving the cans therein, said can receiving means being characterized by a basket portion defining an opening in a lower portion thereof;

can collecting means disposed in said opening, movably connected to said can receiving means between an operating position adjacent to said ground surface and a non-operating position spaced above said ground surface, for engaging cans on said ground surface when in said operating position and moving said cans into said can receiving means; and a carriage wheel attached to said can collecting means for supporting said can collecting means above said ground surface when said can collecting means is in said operating position, said carriage wheel being spaced above said ground surface when said can collecting means is in said non-operating position.

2. The apparatus of claim 1 wherein said can receiving means is positioned substantially forwardly of said can collecting means.

3. The apparatus of claim 1 wherein said can collecting means is hingedly attached to said can receiving means and pivotable between said operating and non-operating positions.

4. The apparatus of claim 1 further comprising locking means for locking said can collecting means is said non-operating position.

5. The apparatus of claim 1 further comprising ground engaging wheels attached to said can receiving means for supporting said can receiving means above said ground surface.

6. The apparatus of claim 1 further comprising:

a tongue attached to said can receiving means; and a trailer hitch disposed on said tongue for engaging a trailer connection on a motor vehicle.

7. The apparatus of claim 6 wherein:

said tongue is pivotally connected to said can receiving means such that said tongue and trailer hitch may be pivoted to one of a plurality of tongue operating positions; and further comprising locking means for locking said tongue in any of said tongue operating positions.

8. The apparatus of claim 1 further comprising can orienting means for orienting said cans substantially longitudinally with respect to said can receiving means prior to collection by said can collecting means.

9. The apparatus of claim 8 wherein said can orienting means is characterized by a plurality of strips hanging downwardly from said can receiving means, said strips being spaced from one another a distance less than a length of at least some of said cans.

10. The apparatus of claim 1 wherein said can collecting means comprises:

a carriage pivotally connected to said can receiving means;

a shaft extending transversely with respect to said carriage and rotatable with respect thereto; an a plurality of flexible discs attached to said shaft and mutually rotatable therewith, said discs being spaced from one another a distance less than a diameter of at least some of said cans such that any pair of said discs deflect away from one another for grippingly engaging a can on said ground surface and, after further rotation, said can is moved adjacent to said can receiving means.

11. The apparatus of claim 10 further comprising a finger extending between adjacent discs whereby said can is disengaged from said discs and freed to fall into said can receiving means.

12. The apparatus of claim 11 wherein said fingers curve upwardly with respect to said can receiving means.

13. The apparatus of claim 10 wherein said carriage wheel is mounted on said shaft.

14. The apparatus of claim 10 further comprising a plurality of hubs attached to said shaft, each of said hubs being positioned between adjacent discs and having an outside diameter less than an outside diameter of said disc.

15. The apparatus of claim 1 wherein an outside diameter of said discs is smaller than an outside diameter of said carriage wheel.

16. An apparatus for collecting cans from a ground surface, said apparatus comprising:

a basket portion defining an opening in a lower portion thereof;

a ground engaging wheel for supporting said basket portion as it is moved along said ground surface;

a carriage positionable in sad opening and hingedly attached to said basket portion such that said carriage has a first position substantially coplanar with said lower portion of said basket portion and a second position pivoted downwardly from said opening;

a shaft extending transversely with respect to said carriage and adjacent thereto;

bearing means on said carriage for rotatably supporting said shaft;

a plurality of flexible discs mounted on said shaft and rotatable therewith, said discs being spaced apart a distance less than a diameter of at least some of said cans and said discs being flexible for grippingly engaging said cans such that the cans are carried by the discs as they rotate;

means for disengaging said cans from said discs such that said cans are free to fall into said basket portion; and a carriage wheel mounted on said shaft and adapted for engagement with said ground surface when said carriage is in said second position, said carriage wheel rotating said shaft and said plurality of flexible discs as it is moved along said ground surface.

17. The apparatus of claim 16 wherein said carriage wheel has an outside diameter greater than an outside diameter of said discs such that said discs do not engage said ground surface when said carriage wheel engages said ground surface.

18. The apparatus of claim 16 further comprising a plurality of hubs disposed on said shaft, each of said hubs being positioned between a pair of adjacent discs, said hubs having an outside diameter less than an outside diameter of said discs.

19. The apparatus of claim 16 wherein said means for disengaging said cans is characterized by an elongated finger extending from said carriage between each pair of adjacent discs.

20. The apparatus of claim 19 wherein said fingers curve upwardly and rearwardly with respect to said basket portion.

21. The apparatus of claim 16 further comprising locking means for locking said carriage in said first position.

22. The apparatus of claim 16 further comprising means for attaching said basket portion to a trailer connection on a vehicle.

23. The apparatus of claim 22 wherein said means for connecting comprises:

an elongated tongue pivotally connected to said basket portion, said tongue being pivotable between a plurality of operating positions with respect to said basket portion; and a trailer hitch attached to said tongue and adapted for engaging the trailer connection.

24. The apparatus of claim 23 further comprising locking means for locking said tongue in any of said operating positions.

25. The apparatus of claim 16 further comprising:

a frame attached to said basket portion forward of said carriage;

a plurality of rods attached to said frame and extending longitudinally with respect to said basket portion; and a plurality of elongated strips, each of said strips being pivotally connected to one of said rods and hanging downwardly therefrom, a lower edge of said strips being spaced from said ground surface a distance less than a diameter of at least some of said cans, and wherein said strips are transversely spaced a distance less than a length of at least some of said cans.

26. An apparatus for collecting cans from a ground surface, said apparatus comprising:

upwardly opening can receiving means for receiving the cans therein;

ground engaging wheels attached to said can receiving means for supporting said can receiving means above said ground surface;

can collecting means adjacent to said can receiving means for grippingly engaging cans on said ground surface and thereafter moving sad cans toward said can receiving means;

a carriage wheel attached to said can collecting means for supporting said can collecting means:

a tongue connected to said can receiving means and pivotable to a plurality of tongue operating positions;

a trailer hitch disposed on said tongue for engaging a trailer connection on a vehicle; and a guide attached to a front portion of said can receiving means through which said tongue extends.

27. The apparatus of claim 26 further comprising locking means for locking said tongue in any of said tongue operating positions.

* * * * *